US011330871B2

(12) United States Patent
Paik et al.

(10) Patent No.: US 11,330,871 B2
(45) Date of Patent: May 17, 2022

(54) CLIP FOR ATTACHMENT ACCESSORIES OF BACKPACK

(71) Applicant: WOOJIN PLASTIC Co., Ltd., Namyangju-si (KR)

(72) Inventors: Ji Sook Paik, Seoul (KR); Nan Hee Paik, Seoul (KR); Ji Hye Paik, Seoul (KR); Ji Won Son, Seoul (KR)

(73) Assignee: WOOJIN PLASTIC Co., Ltd., Namyangju-si (KR)

( * ) Notice: Subject to any disclaimer, the term of this patent is extended or adjusted under 35 U.S.C. 154(b) by 0 days.

(21) Appl. No.: 17/195,028

(22) Filed: Mar. 8, 2021

(65) Prior Publication Data

US 2021/0289890 A1 Sep. 23, 2021

(30) Foreign Application Priority Data

Mar. 17, 2020 (KR) ..... 10-2020-0032449

(51) Int. Cl.

*A44B 6/00* (2006.01)
*A45F 5/00* (2006.01)
*A45F 3/00* (2006.01)

(52) U.S. Cl.

CPC ..... *A44B 6/00* (2013.01); *A45F 5/00* (2013.01); *A45F 2003/001* (2013.01)

(58) Field of Classification Search

CPC ..... A44B 6/00; A44B 11/10; Y10T 24/1394; Y10T 24/1397; Y10T 24/1391

See application file for complete search history.

(56) References Cited

U.S. PATENT DOCUMENTS

| | | | | |
|---|---|---|---|---|
| 3,808,642 | A * | 5/1974 | Nation | A44B 99/00 24/3.11 |
| 5,293,673 | A | 3/1994 | Murai | |
| 5,983,686 | A | 11/1999 | Lee | |
| 6,032,337 | A | 3/2000 | Rankin, Jr. et al. | |
| 8,713,764 | B1 | 5/2014 | Rittenhouse et al. | |
| 2005/0257353 | A1* | 11/2005 | Rohrig | A45F 5/02 24/537 |
| 2011/0289733 | A1* | 12/2011 | Del Solar | A44B 6/00 24/3.12 |
| 2015/0122855 | A1 | 5/2015 | Parsons et al. | |
| 2019/0137033 | A1 | 5/2019 | Chen | |

FOREIGN PATENT DOCUMENTS

| | | | |
|---|---|---|---|
| KR | 10-0985455 | B1 | 10/2010 |
| WO | WO 2010/141487 | A1 | 12/2010 |

OTHER PUBLICATIONS

Extended European Search Report for related EP application No. 21161786.5 dated Jul. 14, 2021 from European Patent Office.

* cited by examiner

*Primary Examiner* — Robert Sandy

(74) *Attorney, Agent, or Firm* — Paratus Law Group, PLLC

(57) ABSTRACT

Disclosed is a clip for attachment accessories of a backpack. The clip includes: a blade formed in a long plate shape; a clip part formed by an end portion of the blade which is bent; a movable clip having a pair of arms which extend from both sides of a base part thereof and are combined with both sides of the clip part to be movable in a longitudinal direction of the clip part; and a locking means for maintaining a state where the movable clip is moved toward the surface of the blade.

12 Claims, 12 Drawing Sheets

CLIP FOR ATTACHMENT ACCESSORIES OF BACKPACK

CROSS REFERENCE TO PRIOR APPLICATION

This application claims priority to Korean Patent Application No. 10-2020-0032449 filed on Mar. 17, 2020, which is hereby incorporated by reference in its entirety.

BACKGROUND

The present invention relates to a clip for attachment accessories of a backpack, and more particularly, to a clip for attachment accessories of a backpack, which can easily attach and detach attachment accessories to and from a backpack to which a molle system for attaching pouches or accessories to an external surface of the backpack is applied.

People put clothes, food or various necessary items in their backpacks, and shoulder the backpacks in order to move when climbing a mountain or taking a trip. People use backpacks of various types according to their purposes.

Especially, most of military backpacks are backpacks to which a molle system is applied (hereinafter, called a 'molle backpack'). In order to carry lots of tools and items when soldiers carry out an operation for a long time, the molle backpack includes strap loops formed by a plurality of straps arranged and sewed at regular intervals horizontally in parallel on an external surface of the backpack, and soldiers can connect and attach various pouches, devices, tools or items to the strap loops to carry them.

That is, the backpack has strap loops on the external surface and pouches to be attached to the backpack also have strap loops on their external surfaces, so that each of the pouches can be fixed to the backpack when a strap connects the strap loop of the backpack and the strap loop of the pouch with each other.

Because of excellent expandability of such backpacks, recently mountain climbers or travelers use such backpacks widely, and the following patent document 1 shows an example of such molle backpack.

However, the conventional molle backpacks are very inconvenient in use since separate straps are inserted and tied into the strap loops of the backpack and the pouches in order to connect and attach the pouches to the backpack and users have to untie the straps one by one in order to separate the pouches from the backpack.

RELATED ART

Patent Document 1: Korean Patent No. 10-0985455 (Sep. 29, 2010)

SUMMARY

Accordingly, the present invention has been made to solve the above-mentioned problems occurring in the prior arts, and it is an object of the present invention to provide a clip for attachment accessories of a backpack, which allows a user to easily attach and detach attachment accessories, such as pouches or items, to and from a molle backpack.

It is another object of the present invention to provide a clip for attachment accessories of a backpack, which allows the user to easily manipulate the clip for attaching and detaching the attachment accessories to and from the backpack.

It is a further object of the present invention to provide a clip for attachment accessories of a backpack, which can stably maintain connection between the backpack and the accessories just by a simple manipulation, and which allows the user to easily detach the accessories from the backpack by the simple manipulation.

To accomplish the above object, according to the present invention, there is provided a clip for attachment accessories of a backpack including: a blade formed in a long plate shape; a clip part formed by an end portion of the blade which is bent, the clip having a free end of which the inner surface approaches the surface of the blade; a movable clip having a pair of arms which extend from both sides of a base part thereof and are combined with both sides of the clip part to be movable in a longitudinal direction of the clip part, each of the arms having a hook part formed at a front part thereof to face the surface of the blade; and a locking means for maintaining a state where the movable clip is moved toward the surface of the blade, wherein the hook parts approach the blade when the movable clip moves toward the front end of the clip part, but are separated from the blade when the movable clip moves backwards.

The clip part includes guide grooves formed at both sides lengthways, and the movable clip includes guide protrusions formed on the inner surfaces of the front ends of the arms, so that the movable clip moves within a range of the guide grooves when the guide protrusions are put into the guide grooves.

The end portion of the clip part is bent from one end portion of the blade to approach the surface of the blade in an inclined state.

Front end portions of the hook parts get in contact with the surface of the blade when the movable clip moves toward the front end of the clip part, and concave grooves for receiving the front ends of the hook parts are formed on the surface of the blade with which the hook parts get in contact.

The clip part has guide grooves formed at both sides lengthways and the movable clip has guide protrusions formed on the inner surfaces of the front ends of the arms so that the movable clip moves within a range of the guide grooves when the guide protrusions are put in the guide grooves, the movable clip includes stoppers protruding from the inner surfaces of the rear sides of the arms, so that when the movable clip moves toward the front end of the clip part, the stoppers finally enter into the guide grooves by applying a predetermined pressure while getting in contact with retaining jaws of the clip part when the movable clip moves toward the front end of the clip part, and moves backwards by applying a predetermined pressure after entering.

The guide grooves and the guide protrusions are coupled with each other with a predetermined clearance.

The locking means includes: a first retaining part protruding from a rear end portion of the clip part and bent toward the movable clip; and a second retaining part which makes an end of a base part of the movable clip caught to the first retaining part when the movable clip moves toward the front end of the clip part.

The first retaining part and the second retaining part have inclined surfaces formed at their edges getting in contact with each other for mutual coupling.

The movable clip has a holding part formed at an end portion of the rear side thereof.

The blade has both sides of which middle portions are thick in cross section.

The blade has a rib formed at the middle portion of the rear side longways.

According to the present invention, because the clip part is bent and formed integrally with the blade and the movable clip is mounted to be movable, when the user puts the blade in the strap loops of the backpack and the attachment accessories and presses the movable clip in the direction that the blade is put, the attachment accessories can be attached to the backpack simply. In order to separate the attachment accessories from the backpack, just when the user pulls the strap connected to the holding part of the movable clip, the attachment accessories can be easily detached from the backpack.

The clip according to the present invention can stably maintain the state where the attachment accessories are attached to the backpack since the clip has the locking means for maintaining the state where the hook part of the movable clip engages with the strap fit to the clip part.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
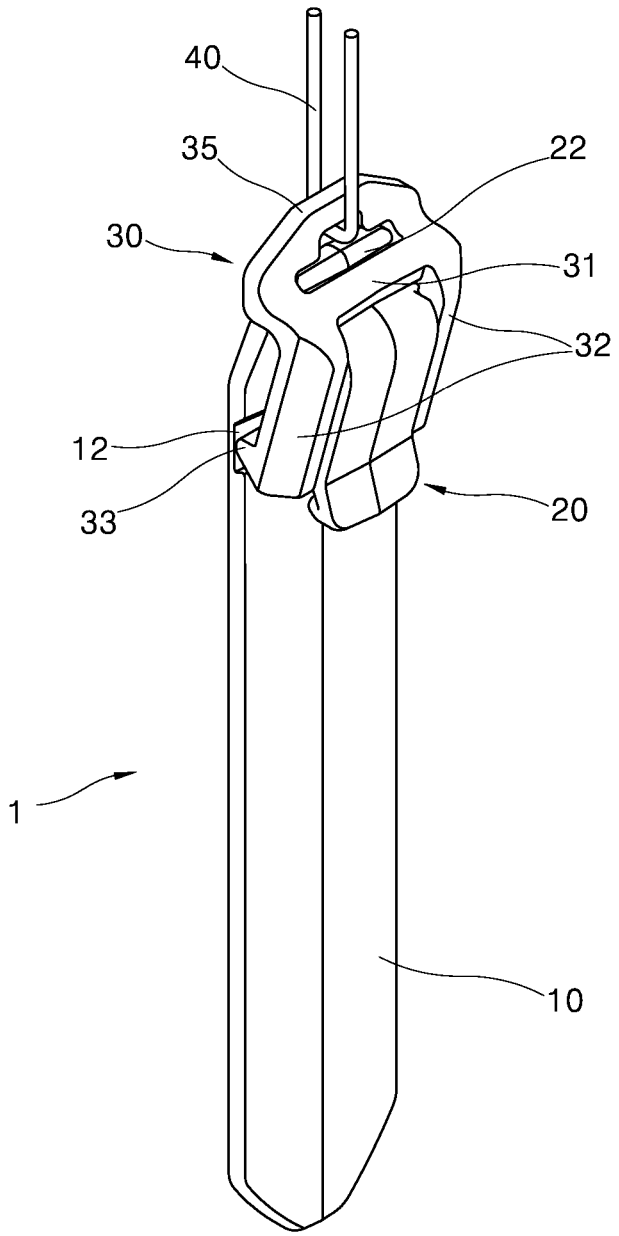
FIG. 1 is a perspective view showing an example of a clip according to the present invention.
Figure 2:
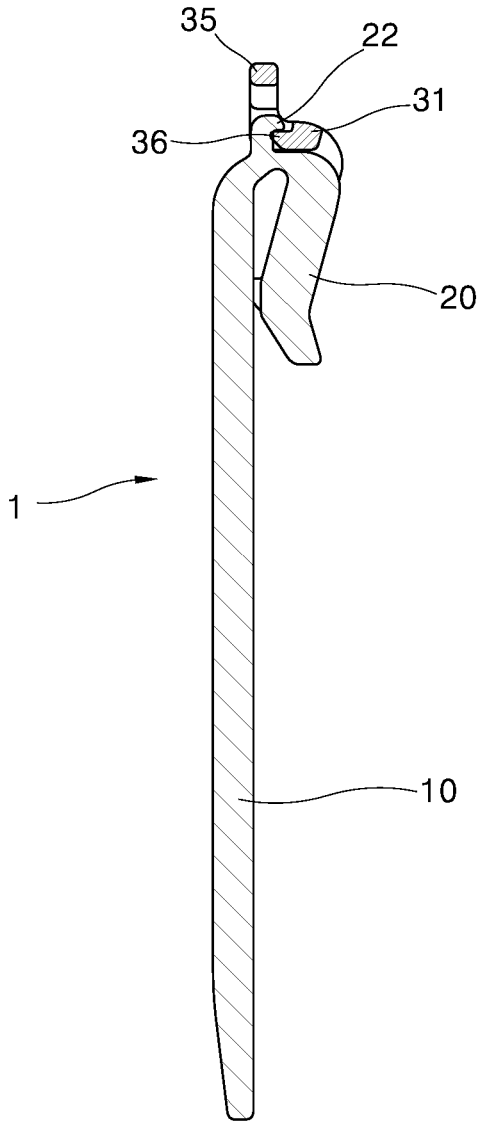
FIG. 2 is a side sectional view of FIG. 1.
Figure 3:
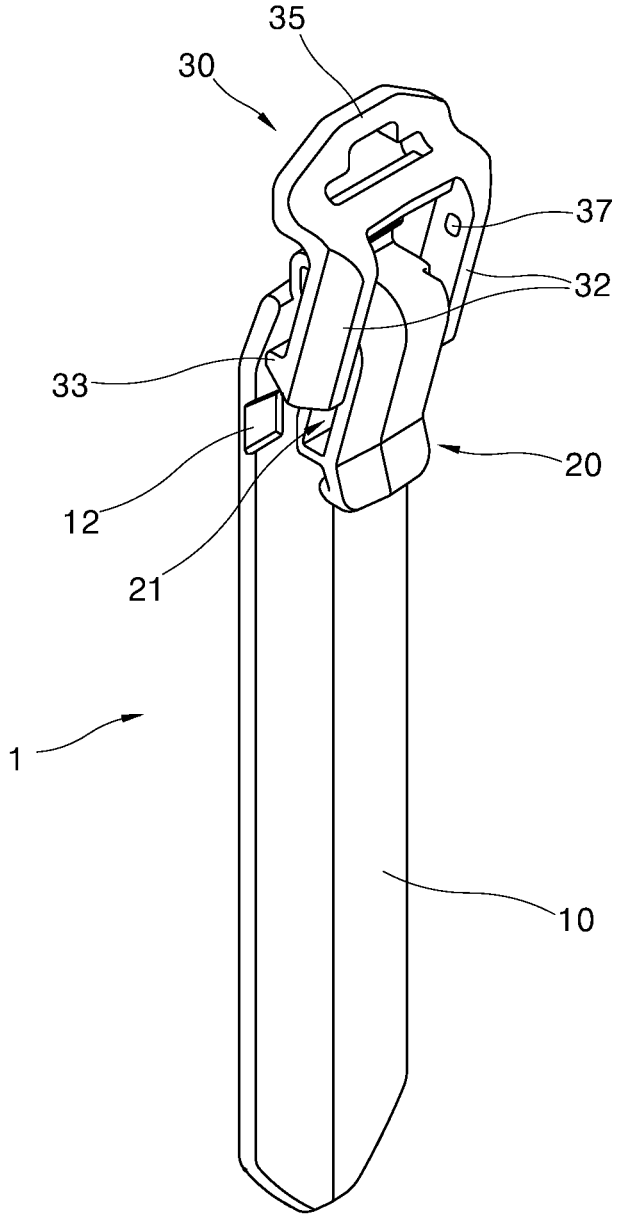
FIG. 3 is a perspective view of the clip showing a state where a movable clip of the present invention moves backwards.
Figure 4:
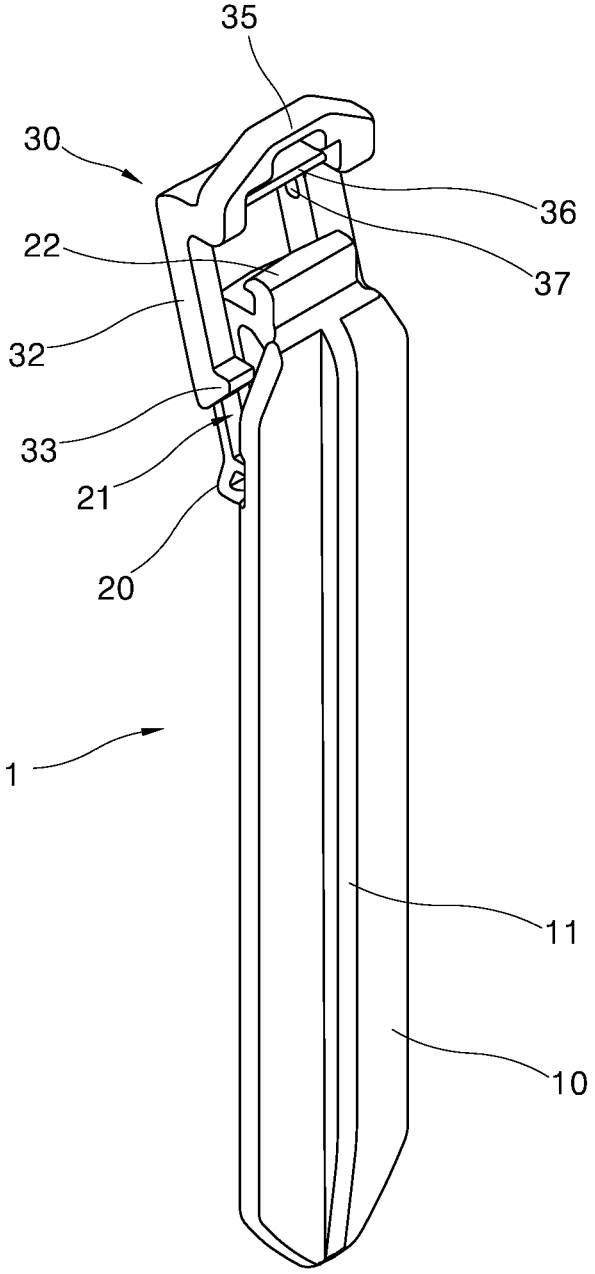
FIG. 4 is a perspective view of the rear side of the clip of FIG. 3.
Figure 5:
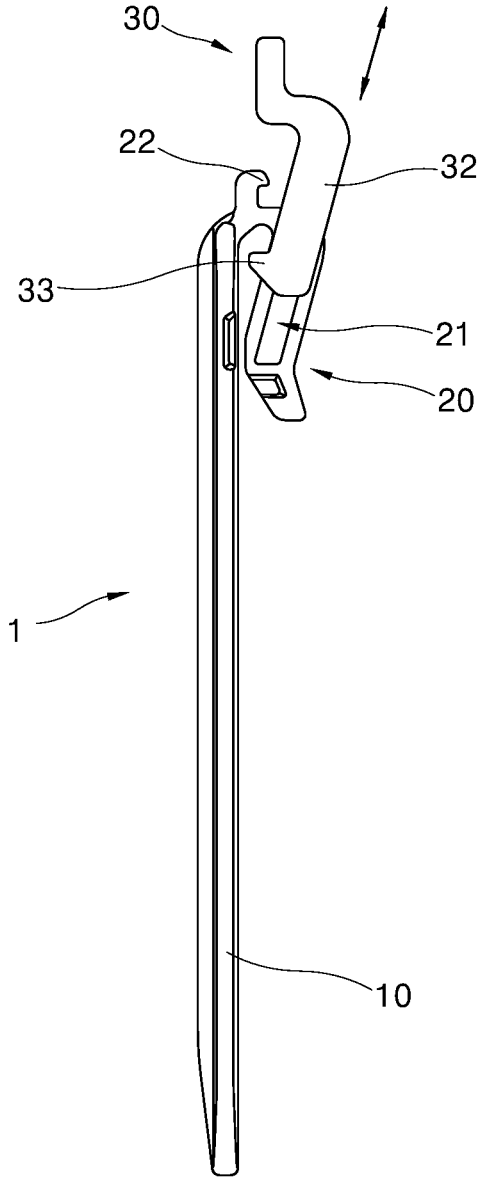
FIG. 5 is a side view of FIG. 3.

Hereinafter, an embodiment of the present invention will be described in detail with reference to the accompanying drawings. In the drawings, thicknesses of lines and sizes of constituent elements may be exaggerated for clarity and convenience in explanation.

Moreover, wordings to be described later are defined in consideration of the functions of the present invention, and may differ depending on the intentions of a user or an operator or custom. Accordingly, such wordings should be defined on the basis of the contents of the overall specification.

Referring to FIGS. 1 to 8, a clip 1 according to the present invention includes a blade 10, a clip part 20, and a movable clip 30.

The blade 10 is formed in a long plate shape, and has a front end portion which is narrow and a front side and a rear side of which middle portions have convex cross sections, so as to be easily put in a strap loop and to slide smoothly.

The blade 10 has a rib 11 formed at the middle portion of the rear side longways to reinforce strength of the blade and to make the blade 10 slide smoothly in relation to a contact surface of the backpack.

The clip part 20 is formed integrally with the blade 10, is bent at an end portion of the rear side of the blade 10, and has a free end of which the inner surface approaches the surface of the blade 10.

The clip part 20 has an inclination angle relative to the blade 10 so that a front end portion approaches the surface of the blade 10 from the rear side, and the front end portion of the inner surface has an outward inclination angle formed from the blade 10 so as to easily induce the strap when the strap is put in the clip part 20.

The clip part 20 has guide grooves 21 formed at both sides lengthways, and the movable clip 30 is combined with the guide grooves 21.

The movable clip 30 includes: a pair of arms 32 extending from both sides of a base part 31 thereof and combined with both outer surfaces of the clip part 20 to be able to move in the lengthwise direction of the clip part 20; and hook parts 33 formed at front end portions of the arms 32 to face the surface of the blade 10.

The movable clip 30 further includes guide protrusions 34 formed on inner surfaces of the front end portions of the arms 32 to be combined with the guide grooves 21 so that the guide protrusions 34 can move within a stroke distance of the guide grooves 21.

Preferably, the guide grooves 21 and the guide protrusions 34 are coupled with each other with somewhat clearance. The guide protrusions 34 may have any shape, but it is preferable that the guide protrusions 34 may have a rectangular shape or one of shapes similar to the rectangular shape in order to prevent free rotation of the movable clip 30.

The movable clip 30 includes a holding part 35 formed at a rear end portion thereof to allow connection of a strip 40.

In the state where the movable clip 30 is combined with the clip part 20, the hook parts 33 of the movable clip 30 face the surface of the blade 10 from outer surfaces of the clip part 20. In order to make the hook parts 33 of the movable clip 30 face the surface of the blade 10, the clip part 20 is formed to be narrower than the blade 10, so that the entire width of the clip part 20 and the arms 32 of the movable clip 30 corresponds to the width of the blade 10.

The movable clip 30 combined with the clip part 20 is guided to the guide grooves 21 to be movable. Because the clip part 20 is inclined relative to the blade 10, the hook parts 33 approach the blade 10 to get in contact with the blade 10 when the movable clip 30 moves toward the front end of the clip part 20, and is separated from the blade 10 when the movable clip 30 moves toward the rear side of the clip part 20.

Here, concave grooves 12 for receiving the front ends of the hook parts 33 may be formed on the surface of the blade 10 with which the hook parts 33 get in contact when the movable clip 30 moves toward the front end of the clip part 20. When the hook parts 33 are inserted into the concave grooves 12, the strap put between the blade 10 and the movable clip 30 can be fastened firmly.

Figure 6:
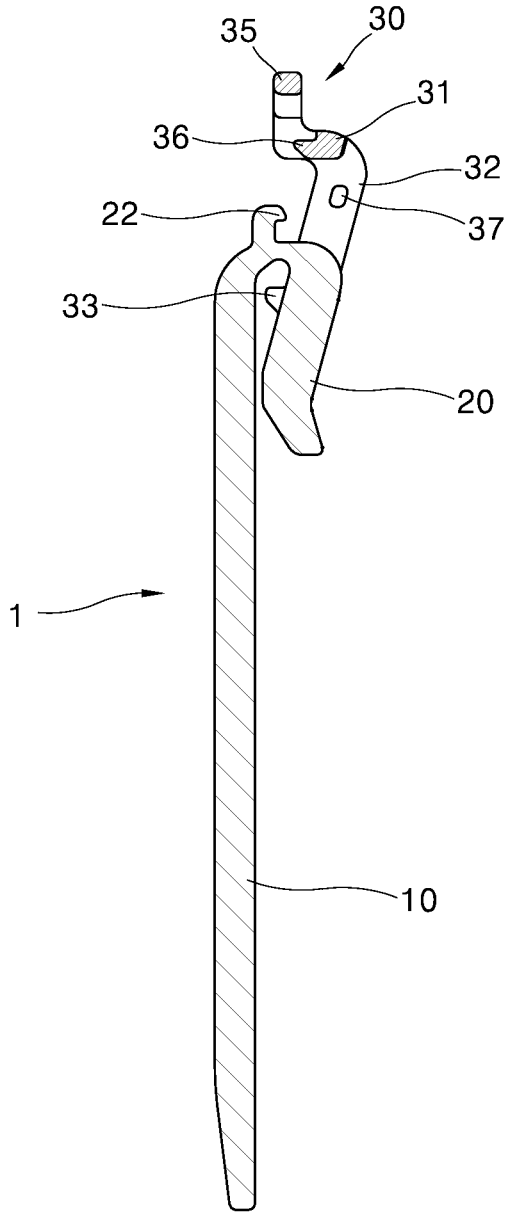
FIG. 6 is a side sectional view of FIG. 3.
Figure 7:
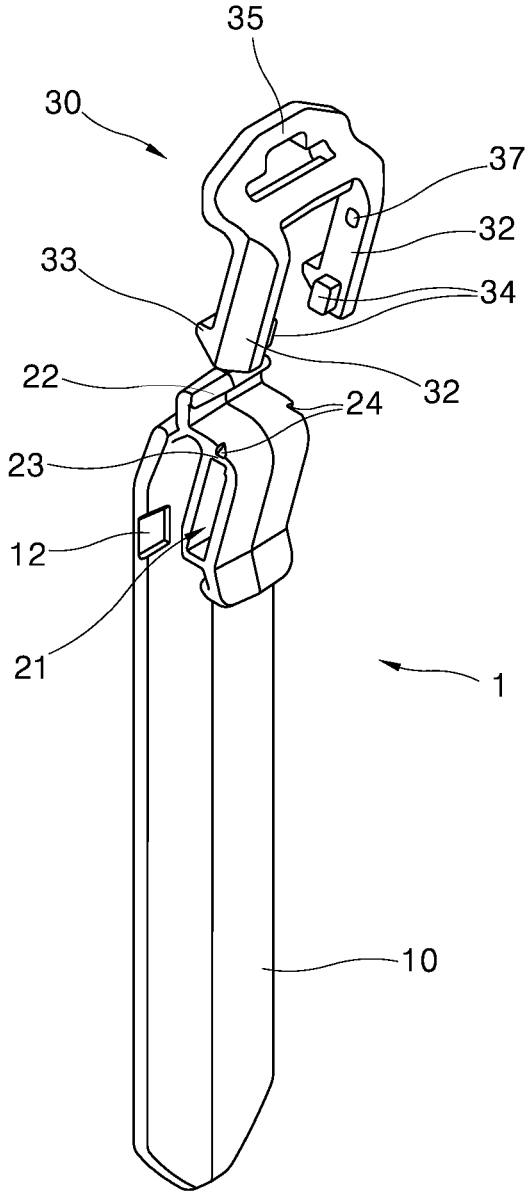
FIG. 7 is an exploded perspective view of the clip according to the present invention.
Figure 8:
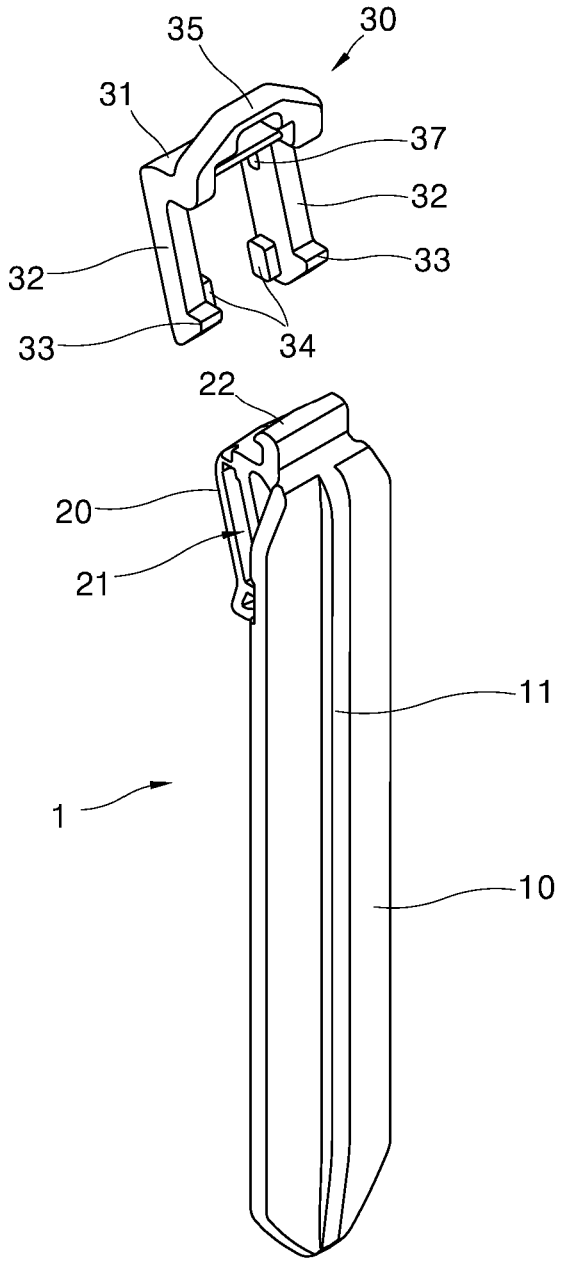
FIG. 8 is a perspective view of the rear side of the clip of FIG. 7.

The clip 1 according to the present invention includes locking means for maintaining the state where the hook parts 33 get in contact with the surface of the blade 10 by forward movement of the movable clip 30. Referring to FIGS. 6 to 8, the locking means includes: a first retaining part 22 protruding from a rear end portion of the clip part 20 and bent toward the movable clip 30; and a second retaining part 36 which makes an end of the base part 31 of the movable clip 30 caught to the first retaining part 22 when the movable clip 30 moves toward the front end of the clip part 20.

Therefore, when the movable clip 30 moves toward the front end of the clip part 20, the first retaining part 22 and the second retaining part 36 keep the state where they are combined and fixed with each other. In order to separate the first retaining part 22 from the second retaining part 36, a user moves the movable clip 30 a little so as to separate the first retaining part 22 and the second retaining part 36 from each other, and moves the movable clip 30 backwards.

Here, because the guide protrusions 34 of the movable clip 30 and the guide grooves 21 of the clip part 20 are coupled with each other with somewhat clearance as described above, the first retaining part 22 and the second retaining part 36 can be separated from each other just by slight movement using the clearance.

The first retaining part 22 and the second retaining part 36 may have inclined surfaces or curved surfaces on their outer edges in order to make them combined with each other smoothly.

Furthermore, in the drawings, the clip 1 according to the present invention includes another locking means. Referring to FIGS. 7 and 8, the clip part 20 has guide grooves 21 formed at both sides lengthways, and the movable clip 30 has guide protrusions 34 formed on the inner surfaces of the front ends of the arms 32. When the guide protrusions 34 are put in the guide grooves 21, the movable clip 30 moves within a range of the guide grooves 21. The movable clip 30 further includes stoppers 37 protruding from the inner surfaces of the rear sides of the arms 32. When the movable clip 30 moves toward the front end of the clip part 20, the stoppers 37 finally apply some pressure while getting in contact with retaining jaws 23, which correspond to external walls of the clip part 20, so as to enter into the guide grooves 21. After entering, the stoppers 37 also apply some pressure to move backwards.

Therefore, the locking means may be the contact between the stoppers 37 and the retaining jaws 23 when the stoppers 37 enter into the guide grooves 21, and here, each of the retaining jaw 23 may have an inducing groove 24 formed on the outer surface thereof so that the stoppers 37 can more smoothly enter the retaining jaws 23.

Now, an action of the clip according to the present invention will be described in detail as follows.

Figure 9:
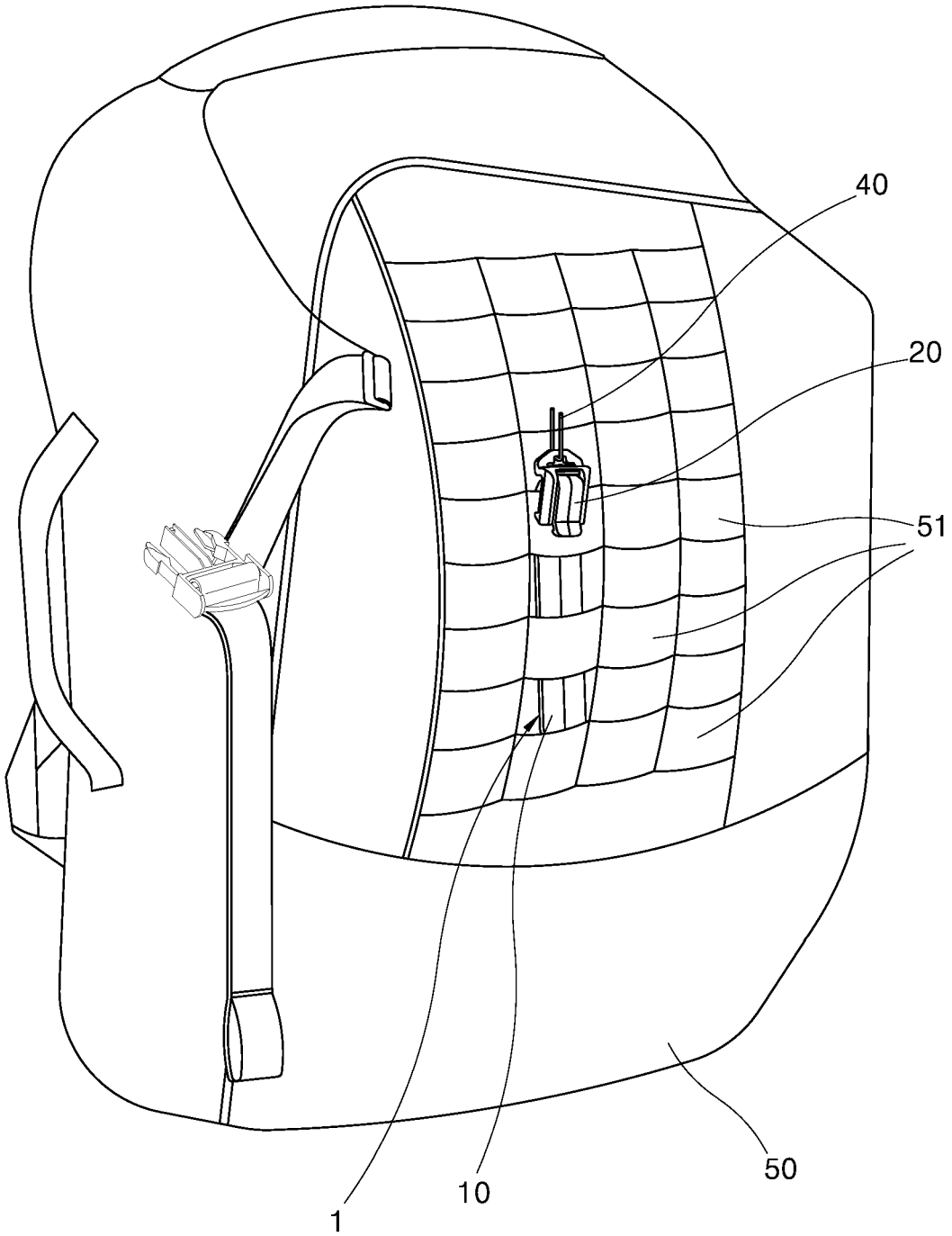
FIG. 9 is a view showing a state where the clip according to the present invention is fit to a strap loop of a backpack.
Figure 10:
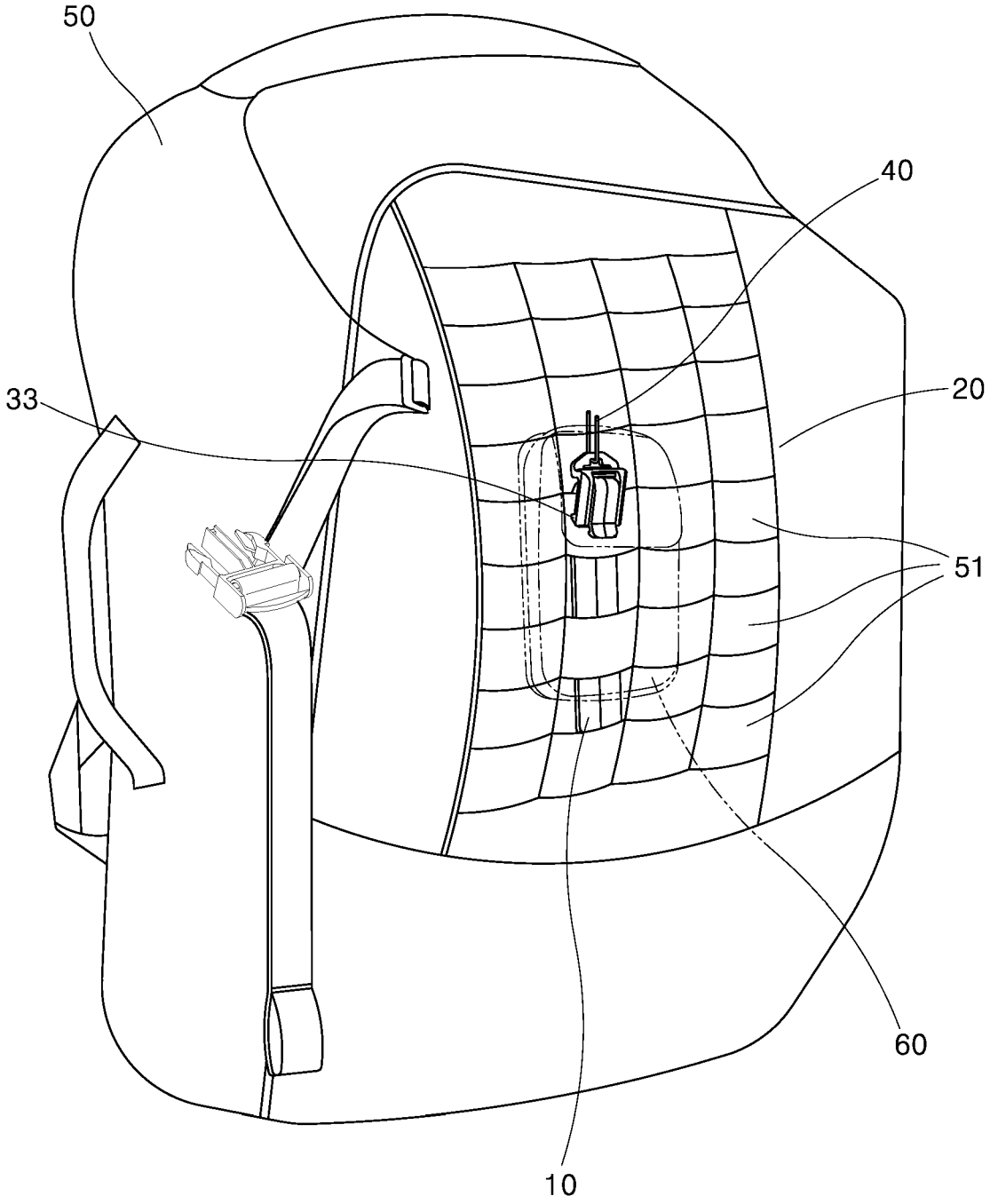
FIG. 10 is an exemplary view showing a state where an attachment accessory is attached to the backpack.
Figure 11:
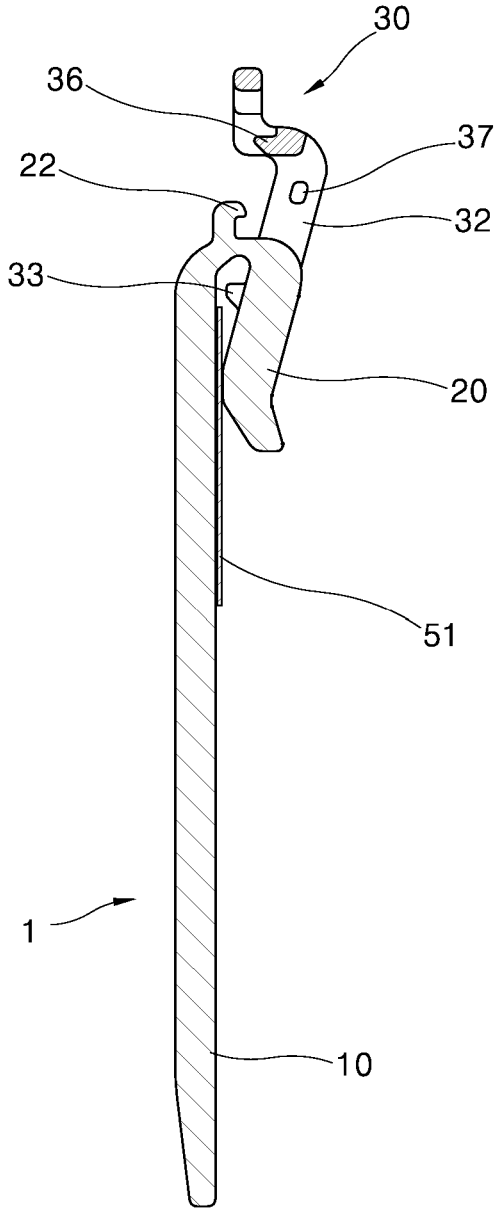
FIG. 11 is a side sectional view showing a state where a strap loop is fit to the clip according to the present invention.
Figure 12:
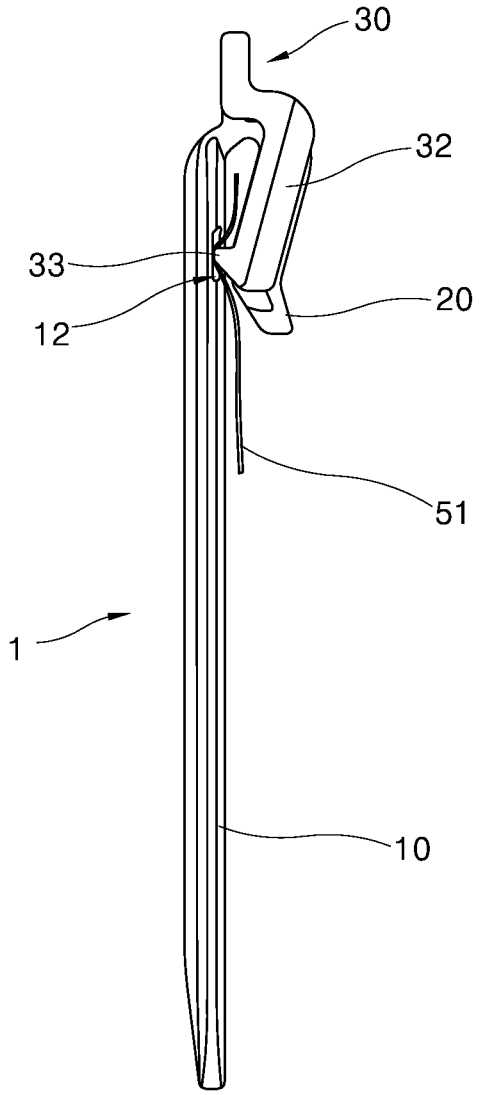
FIG. 12 is a side sectional view showing a state where the movable clip engages with the strap loop.

FIG. 9 is a view showing a state where the clip according to the present invention is fit to a strap loop of a backpack, FIG. is an exemplary view showing a state where an attachment accessory is attached to the backpack, FIG. 11 is a side sectional view showing a state where a strap loop is fit to the clip according to the present invention, and FIG. 12 is a side sectional view showing a state where the movable clip engages with the strap loop. Referring to the drawings, strap loops 51 formed on the outer surfaces of a backpack 50 and a pouch 60 face each other alternately, and the blade 10 of the clip 1 according to the present invention is inserted into the strap loops 51 of the backpack 50 and the pouch 60 sequentially, so that the pouch 60 is attached to the outer surface of the backpack 50.

The pouch 60 can be attached to the outer surface of the backpack 50 just by the above condition, and can keep the attached state if the clip 1 does not get out of the strap loops 51.

In this instance, the strap loops 51 are fit between the blade 10 and the clip part 20 of the clip 1. In the above state, when the user presses down the movable clip 30 to move, the hook parts 33 of the movable clip 30 engage with the blade 10 and press the strap loops 51. Then, the first retaining part 22 and the second retaining part 36 of the locking means engage with each other, and the stoppers 37 go over the retaining jaws 23 and enter into the guide grooves 21, so that the hook parts 33 fasten the strap loops 51 while pressing the strap loops 51.

That is, as soon as the clip 1 is put in the strap loops 51 downwards, the movable clip 30 is pressed and the hook parts 33 engage with the strap loops 51 at the same time.

When the blade 10 is put in the strap loops 51, the rib 11 formed on the rear surface of the blade 10 lengthways serves to reduce a friction area against the backpack so as to promote a smooth sliding.

In order to separate the clip 1 from the strap loops 51 after using the clip 1 in the state where the clip 1 is fastened to the strap loops 51, when the user pulls the strap 40, which is connected to the holding part 35 of the top of the clip 1, upwards, because the movable clip 30 is combined with the clip part 20 in such a way as to be movable in an inclination direction and the guide grooves 21 and the guide protrusions 34 are coupled with each other with the slight clearance, the first retaining part 22 and the second retaining part 36 are separated from each other, and at the same time, the stoppers 37 get out of the guide grooves 21. The movable clip 30 and the hook parts 33 move backwards to be separated from the strap loops 51, so that the clip 1 is separated from the strap loops 51. When the clip 1 is separated from the strap loops 51, the pouch 60 can be separated from the backpack 50.

Such a separation process to separate the hook parts 33 from the strap loops 51 and to take the clip 1 out of the strap loops can be carried out at once just by the action to pull the strap 40 upwards.

Finally, the pouch 60 can be simply separated from the backpack 50 just by the simple action to pull the strap 40 upwards.

While the present invention has been particularly described with reference to exemplary embodiments, the present invention is not limited thereto. It will be understood by those skilled in the art that various modifications and applications may be made without departing from the spirit and scope of the present invention. For instance, shapes or detailed combination states of the blade, the clip part, the movable clip, the retaining portions, the stoppers, and others can be varied properly as occasion demands.

What is claimed is:

1. A clip for attachment accessories of a backpack comprising:

a blade formed in a long plate shape;

a clip part formed by an end portion of the blade which is bent, the clip part having a free end of which an inner surface approaches a surface of the blade;

a movable clip having a pair of arms which extend from both sides of a base part thereof and are combined with both sides of the clip part to be movable in a longitudinal direction of the clip part, each of the arms having a hook part formed at a front part thereof to face the surface of the blade; and a locking means for maintaining a state where the movable clip is moved toward the surface of the blade, wherein the hook parts approach the blade when the movable clip moves toward a front end of the clip part, but are separated from the blade when the movable clip moves backwards.

2. The clip according to claim 1, wherein the clip part includes guide grooves formed at both sides lengthways, and the movable clip includes guide protrusions formed on inner surfaces of front ends of the arms, so that the movable clip moves within a range of the guide grooves when the guide protrusions are put into the guide grooves.

3. The clip according to claim 2, wherein the guide grooves and the guide protrusions are coupled with each other with a predetermined clearance.

4. The clip according to claim 1, wherein an end portion of the clip part is bent from the end portion of the blade to approach the surface of the blade in an inclined state.

5. The clip according to claim 1, wherein front end portions of the hook parts get in contact with the surface of the blade when the movable clip moves toward the front end of the clip part, and concave grooves for receiving the front end portions of the hook parts are formed on the surface of the blade with which the hook parts get in contact.

6. The clip according to claim 1, wherein the clip part has guide grooves formed at both sides lengthways and the movable clip has guide protrusions formed on inner surfaces of front ends of the arms so that the movable clip moves within a range of the guide grooves when the guide protrusions are put in the guide grooves, the movable clip includes stoppers protruding from inner surfaces of rear sides of the arms, so that when the movable clip moves toward the front end of the clip part, the stoppers finally enter into the guide grooves by applying a predetermined pressure while getting in contact with retaining jaws of the clip part when the movable clip moves toward the front end of the clip part, and moves backwards by applying a predetermined pressure after entering.

7. The clip according to claim 6, wherein the guide grooves and the guide protrusions are coupled with each other with a predetermined clearance.

8. The clip according to claim 1, wherein the locking means includes:

a first retaining part protruding from a rear end portion of the clip part and bent toward the movable clip; and a second retaining part which makes an end of a base part of the movable clip caught to the first retaining part when the movable clip moves toward the front end of the clip part.

9. The clip according to claim 8, wherein the first retaining part and the second retaining part have inclined surfaces formed at their edges getting in contact with each other for mutual coupling.

10. The clip according to claim 1, wherein the movable clip has a holding part formed at an end portion of a rear side of the clip part.

11. The clip according to claim 1, wherein the blade has a middle portion thereof thicker than side portions of the blade.

12. The clip according to claim 1, wherein the blade has a rib formed at a middle portion of a rear side of the blade longways.

* * * * *